United States Patent [19]

Lay

[11] Patent Number: 4,696,208

[45] Date of Patent: Sep. 29, 1987

[54] DIRECTION-CHANGEABLE STRUCTURE OF HAND TOOL HANDLE

[76] Inventor: Tsay T. Lay, No. 11, Alley 22, Sec. 2, Change Ping Rd., Taichung, Taiwan

[21] Appl. No.: 948,407

[22] Filed: Dec. 30, 1986

Related U.S. Application Data

[63] Continuation of Ser. No. 808,510, Dec. 13, 1985, abandoned.

[51] Int. Cl.[4] ..... B25B 13/00

[52] U.S. Cl. ..... 81/58; 81/63.1

[58] Field of Search ..... 81/63.1, 63.2, 60, 58; 279/49, 56; 192/43, 43.1

[56] References Cited

U.S. PATENT DOCUMENTS

| | | | |
|---|---|---|---|
| 593,157 | 11/1897 | Furbish | 192/43 |
| 1,127,007 | 2/1915 | Jennings | 279/56 |
| 1,457,570 | 6/1923 | Guthard | 81/177.5 |
| 1,563,178 | 11/1925 | Fegley et al. | 81/63.2 |
| 1,679,299 | 7/1928 | Fegley et al. | 279/56 |

*Primary Examiner*—Frederick R. Schmidt
*Assistant Examiner*—Maurina Rachuba
*Attorney, Agent, or Firm*—Bacon & Thomas

[57] ABSTRACT

A direction-changeable structure of the hand tool handles comprises mainly a body, a coupling tube, and a sleeve. The hand tools of different functions, such as screw driver, thread tapper, socket wrench, etc., can be fixed on the front of the body by a chuck, chucking blocks and a clip to function differently. The body is fixed inside a coupling tube by an arc key which is placed in a key way forming in the inside of the coupling tube. Having a direction selective mechanism attached to it, the main function of the coupling tube is to transmit torque and to select torque transmission direction. The coupling tube can insert into a sleeve which can receive every parts constituting the device according to this invention and fix them together. A handle bar can pass the holes forming in the coupling and sleeve to transmit large torque if necessary.

3 Claims, 9 Drawing Figures

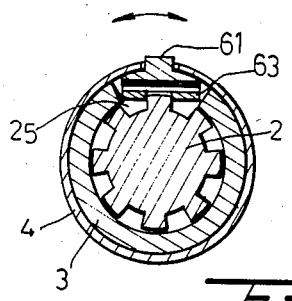
FIG. 4-A
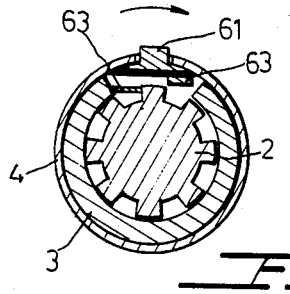
FIG. 4-B
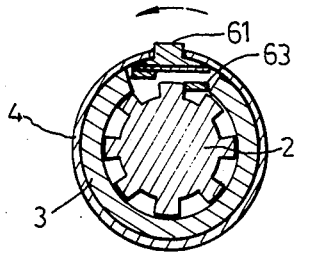
FIG. 4-C

DIRECTION-CHANGEABLE STRUCTURE OF HAND TOOL HANDLE

This is a continuation of application Ser. No. 808,510, filed Dec 13, 1985 and now abandoned.

BACKGROUND OF THE INVENTION

This invention relates to a direction-changeable structure of the hand tool handles and particularly to a hand tool of multi-function and large range of working torque.

In the prior art of hand tools there are versatile designs. Some for single function, the other for multi-function; some for small torque transmission, the other for large torque transmission, etc. The ultimate aim of those is to provide the users with an efficient, powerful and convenient way to have their works done. However, those hand tools which can support large torque without damaging themselves have only single function, and those having multi-function can hardly support large torque and are damaged easily when greater torque is applied.

Referring to FIGS. 5 and 6 these are two conventional hand tools. Both have disadvantages. The hand tool shown on FIG. 6 is more stable in use and would not shake but because it is operated only by thumb and index finger, it can not transmit great torque. The hand tool shown on FIG. 5 is a general one with separate parts. Although it can transmit larger torque than the former can, it is not stable and it shakes in use for the movement of hand is not continuous, and the hand itself must turn back in order to continue rotating the hand tool constantly. Thus, this type of hand tool handle is not suitable for more precise working. Obviously, for works of greater torque and higher concentricity, such as tapping and slightly reaming, the handles mentioned above can not meet the requirements. Particularly, for work that needs high precision at the beginning and great torque later, the handle still needs to be improved.

It is, therefore, the object of the present invention to obviate those drawbacks and to provide a handle of hand tool with multi-function and large range of working torque.

SUMMARY OF THE INVENTION

According to the above-mentioned disadvantages, the basic, original idea of the present invention is to design a handle of hand tool. Not only is the design to provide three different ways for torque transmission, one for clockwise rotation, the other for counterclockwise rotation, another for bi-directional rotation, but also to transmit torques of large range. When load is light, the hand tool can be rotated by only thumb and index finger and held by the other fingers and palm to keep stable and from shaking, and with the uni-direction torque transmission, it is not necessary to loose the user's hold of the handle from time to time as the prior art does. Thus, every light load work can be done quickly and precisely. When the load is heavy, the torque transmission is done by holding the handle with thumb, fingers and palm. When the load is very heavy, a handle bar can be used by passing the holes on the the handle to produce great torque and the hand tool can be held by another hand.

It is the primary object of the present invention to provide an improved structure of hand tool handle with multi-function and a large range of working torque.

It is another object of the present invention to provide an improved structure of hand tool handle having three different ways of torque transmission, one for clockwise rotation, the other for countclockwise rotation and another for bi-directional rotation.

It is still another object of the present invention to provide an improved structure of hand tool handle having a separate handle bar able to engage with the handle easily to produce great torque.

It is a further object of the present invention to provide an improved structure of the hand tool handle able to be operated easily, quickly and precisely.

BRIEF DESCRIPTION OF THE DRAWING

FIG. 4 is a transverse cross-sectional view taken along line 4—4 of FIG. 3.

DETAILED DESCRIPTION OF PREFERRED EMBODIMENT

Figure 1:
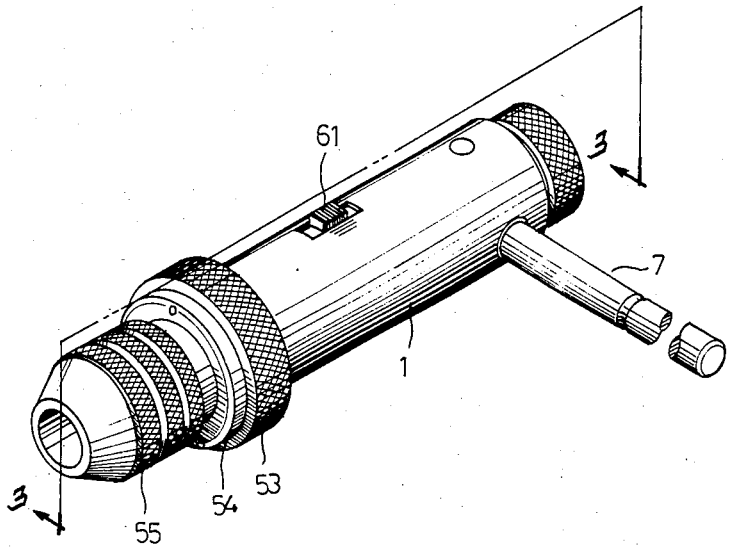
FIG. 1 is a perspective view of a preferred embodiment of the present invention.
Figure 2:
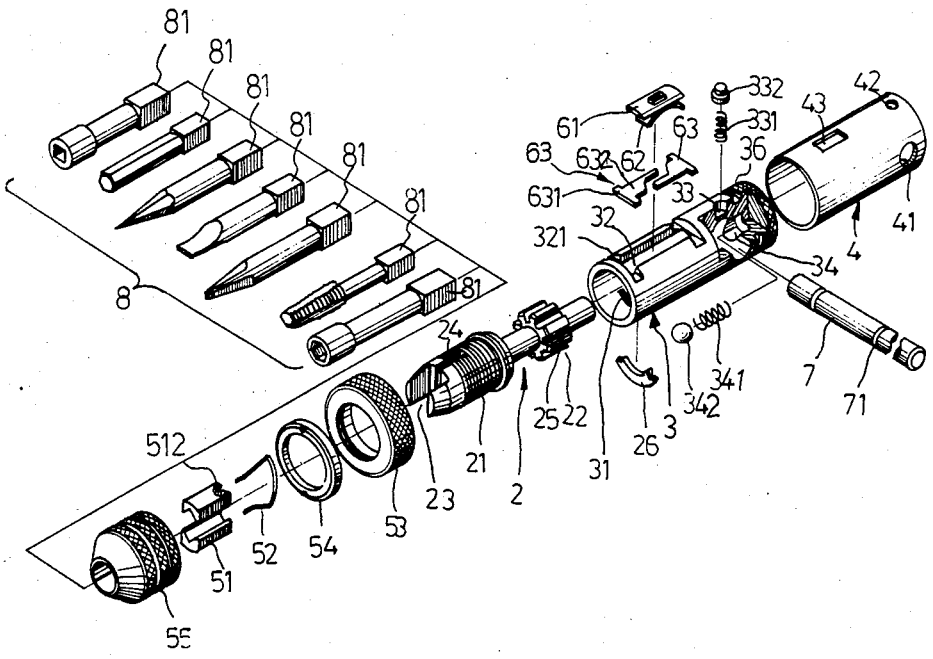
FIG. 2 is a fragmental view of FIG. 1.
Figure 3:
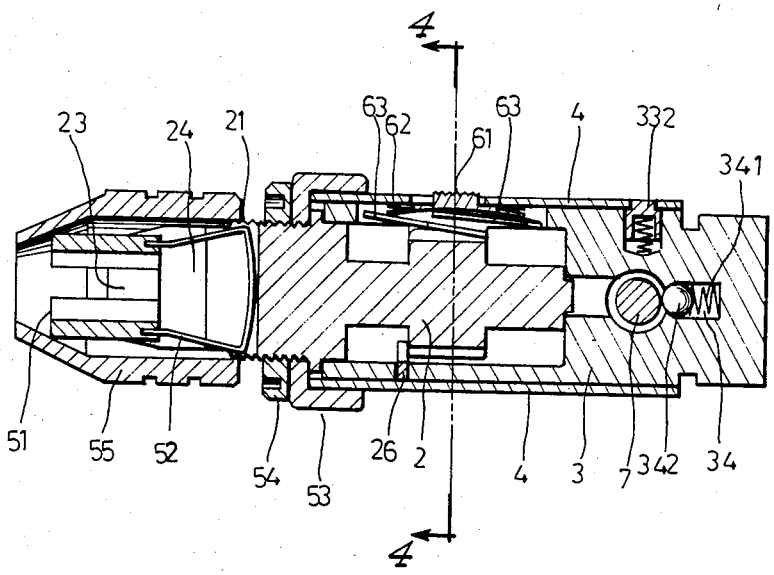
FIG. 3 is a longitudinal cross-sectional view taken along line 3—3 of FIG. 1.
Figure 5:
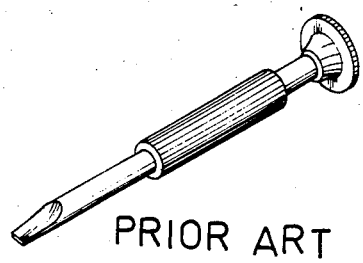
PRIOR ART FIG. 5
FIGS. 5 and 6 are perspective views of two conventional hand tools of prior art.
Figure 6:
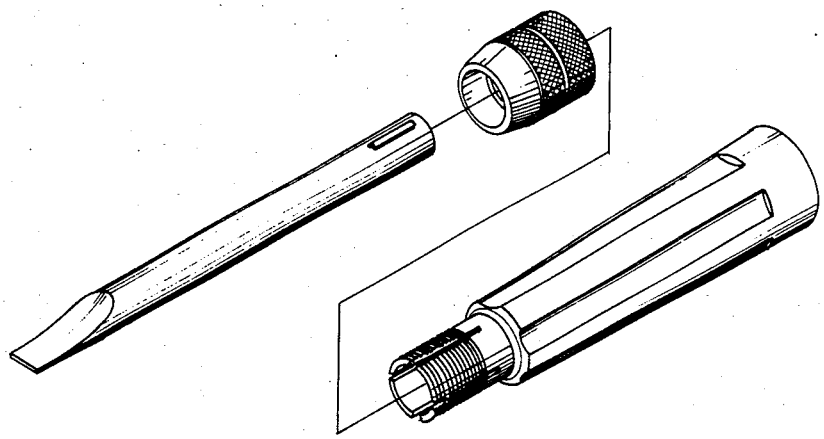
PRIOR ART FIG. 6

Referring to the drawings, and particularly to FIGS. 1, 2 and 3, a direction-changeable structure of hand tool handle comprises five assemblages which would be described detailedly as follows:

The first assemblage comprises a body 2 and a arc key 26. Said body 2 is a slender bar having a gear wheel 22 in rear of the middle point of said slender body 2 a thread 21, a radial slot 24 and a chucking blocks seat 23. The gear wheel 22 can be engaged with T-plates 63 described hereinafter to select the direction of torque transmission. The chucking blocks seat 23 is defined between two arc plates extending parallel to the direction of the slot 24, each arc plate having opposite, flat, inner sides. a pair of chucking blocks 51 coupled by a clip 52 described hereinafter can be placed on the chucking blocks seat 23. When the clip 52 is inserted into radial slot 24, the pair of chucking blocks 51 form a rectangular shape with the two arc plates defining the chucking blocks seat. Therefore, this construction can more steadily and stably fix a tool which has a square cross section on its engagement end when held therein by a chuck 55. The clip 52, therefore, is inserted into said radial slot 24 and held therein by a chuck 55. The thread 21 can engage with two female threaded rings 53, 54 and the chuck 55 to suit the user's convenience to use this invention and to hold the tools. There is an arc key 26 placed in a key way 31 forming on a coupling tube 3 to keep the body 2 within the coupling tube 3 and keep it from slipping out. The arc key 26 is kept from dropping out by a sleeve 4 which couples with the coupling tube 3.

The second assemblage comprises a coupling tube 3, a steel ball 342, an engaging button 332 and two springs 331 and 341. One end of the coupling tube 3 is closed and has knurling 36 on it, while the other end is open. Disposed approximate the knurling 36, are two separated holes 33 and 35. The hole 33 is the seat of the engaging button 332 and the spring 331. The spring 331 is places between the bottoms of the engaging button 332 and hole 33 to keep said engaging button 332 upward against the sleeve 4 when the coupling tube 3 is inserted into the sleeve 4, thus keeping them from separating from each other. Another penetrating hole 35 allows the penetration of a handle bar 7 to provide great torque. To prevent the handle bar 7 from slipping out, there is a seat 34 therefor a ball detent constituted by the steel ball 342 and spring 341. When the handle bar 7 is inserted into the hole 35, the spring 341 would push the steel ball 342 against a circumferential recess 71 formed on the handle bar 7. With the recess 71 matching the steel ball 342, the handle bar 7 would not slip out during operation. On the open end of said coupling tube 3, there are a key way 31 to keep the key 26 therein as described hereinbefore and an "H" slot with the horizontal bar of the "H" in the longitudinal direction of the coupling tube 3 and penetrating the wall of the coupling tube 3 through and two vertical bars tangential to the coupling tube 3. The "H" slot is the seat of the assemblage of direction selection which will be described hereinafter and cooperates threwith in selecting the torque transmission direction.

The third assemblage comprises a sleeve 4. Said the sleeve 4 is to receive the coupling tube 3 and has a square hole 43 and three circular holes 41 and 42 (only two are shown), formed thereon. The square hole 43 corresponds to the direction selection assemblage and the "H" slot. The circular hole 42 corresponds to the engaging button 332 and another two holes 41 are the penetration hole for handle bar 7. After the coupling tube 3 is inserted into sleeve 4, the spring 331 forces the engaging button 332 upward and the thinner top of said engaging button 332 penetrates the small circular hole 42 to keep the sleeve 4 and the coupling tube 3 from separating.

The fourth assemblage comprises several independent parts such as a chuck 55, two chucking blocks 51, a clip 52 and two female-threaded ring 53, 54. One of the two female-threaded ring is thick and assigned 53, the other is thin and assigned 54. On outside cylindrical surface of said thick ring 53, there is knurling to user's convenience to rotate the hand tool with fingers (not shown). After said thick ring 53 is screwed on the thread 21 of the body 2, the thin ring 54, then is also screwed on the thread 21 to keep said thick ring 53 there securely and steadily. The chuck 55, chucking blocks 51 and clip 52 are used to hold different working tools and fix them on the front of the handle 1, Having V-groove on each chucking block 51 in their upper opposite sides, the chucking blocks 51 can receive different polygonal engaged ends 81 of different tools 8 according to the angle of the V-groove such as a 90-degree-V-groove corresponding to a square cross section of the engaged end 81 of a tool. On one end of the other side opposite to the V-grooved side of each chucking block 51, there is a notch 512 for the clip 52 to insert thereinto to keep the chucking blocks 51 from moving back and forth in order that the insertion of a tool into the V-grooves of chucking blocks is easy and smooth. The chucking blocks 51 and clip 52 are placed in the chucking block seat 33 and radial slot 24 as described hereinbefore and, then, secured by the chuck 55. Since the chucking blocks seat 23 has two arc plates extending parallel with the direction of slot 24, when the clip 52 is inserted into the radial slot 24, the pair of chucking blocks 51 form a rectangular shape with the above-mentioned two arc plates. With the thread inside said chuck 55, the tool inserting into the V-grooves is held stably by screwing the chuck 55 such that the chucking blocks 51 close to each other and clamp the engaged end 81 of tool 8.

The fifth assemblage comprises two T-plates 63, and a switch 61 together with a leaf spring 62. The T-plates 63 are placed in the "H" slot 32 of the coupling tube 3 with the horizontal bar of "T" placed in the vertical bar of "H" and the vertical bar of "T" in the horizental bar of "H". When this assemblage is secured on the coupling tube 3 by the sleeve 4, the switch 61 can move left and right to select the direction for torque transmission. Refer particularly to FIGS. 4-A, 4-B and 4-C showing three different conditions for the engagement of said T-plates with said gear wheel 22 of said body 2. Since the vertical bars of "H" shelve down to the horizontal bar of "H", when the horizontal bar 631 of T-plates 63 have not yet been depressed by said leaf spring 62, the tip of vertical bar 632 would fall down by gravity to the gap 25 between two adjacent cogs of the gear wheel 22 and thus engage with gear wheel 22 to transmit torque. If the horizental bar 631 of the T-plate is depressed by the leaf spring 62, the tip of vertical bar 632 would be raised and not engage with the gear wheel 22. With this structure, there are three different ways to transmit torque. In FIG. 4, the switch 61 is placed at middle position and both two T-plates 63 engage with the gear wheel 22, that means the handle 1 according to the present invention can transmit torque in both clockwise and counterclockwise directions. In FIG. 4, the switch 61 is pushed to right as viewed in FIG. 3 and the torque can be transmitted only in clockwise direction. The switch 61 is pushed to left as viewed in FIG. 3 and the torque can be transmitted only in counterclockwise direction.

The handle bar 7 as described hereinbefore can penetrate the hole 35 to provide great torque by leverage and the recess 71 disposed thereon will cooperate with the steel ball 342 to keep the handle bar 7 from slipping out.

Figure 7:
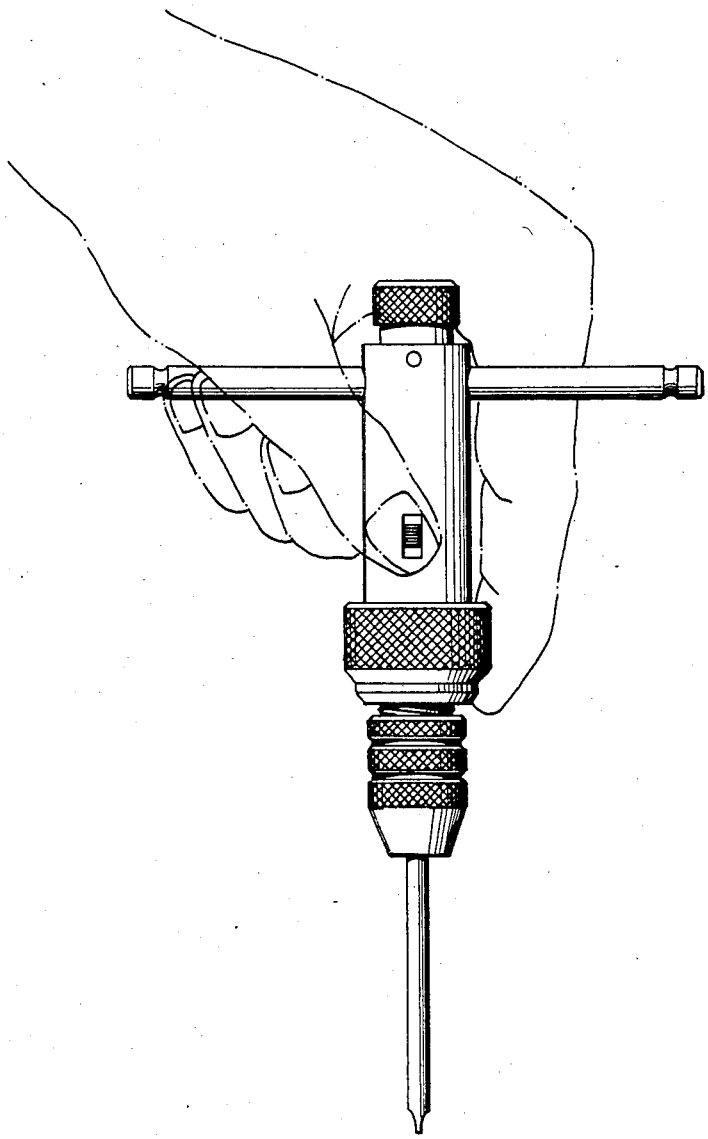
FIG. 7 is a side view of the tool according to the invention showing how the switch of the tool can be adjusted using only the thumb.
Figure 8:
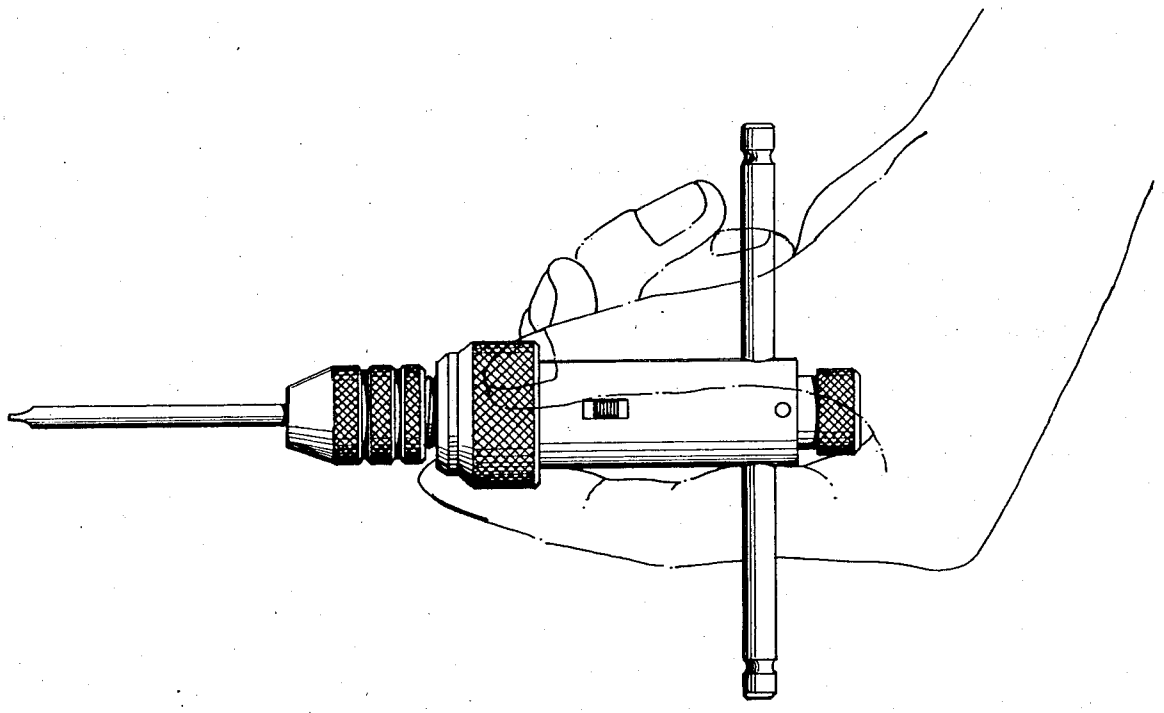
FIG. 8 is a side view of the tool according to the invention showing how the tool can be rotated right and left by the thumb and index finger.
Figure 9:
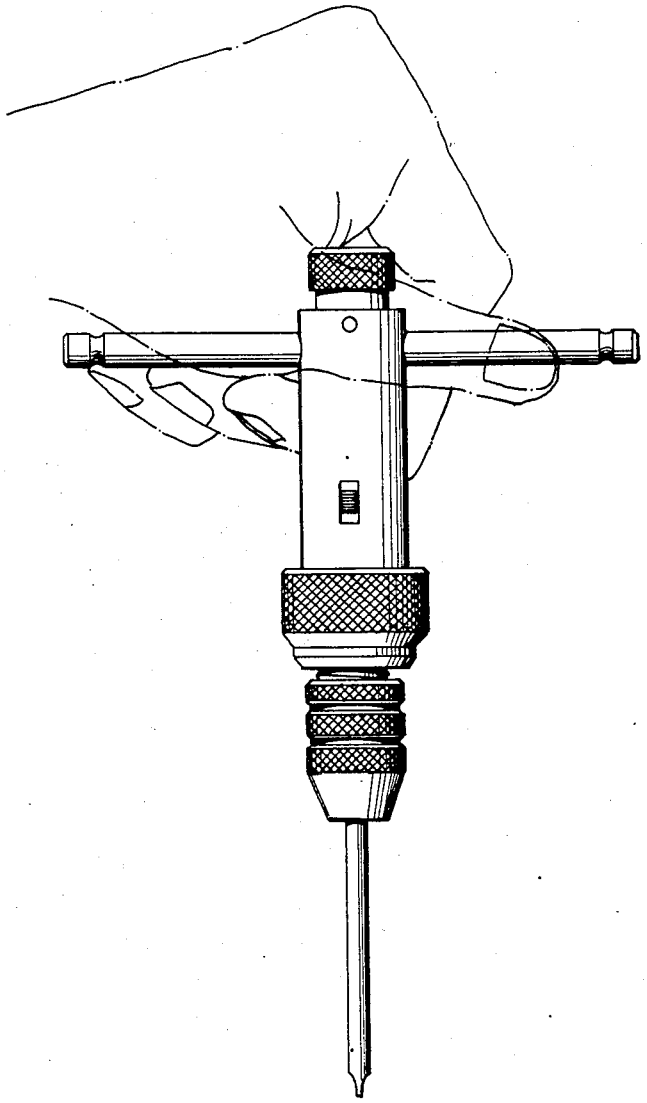
FIG. 9 is a side view of the tool according to the invention showing how the tool can be rotated by holding the handle bar with the thumb, fingers and palm.

According to the above description, the present invention can transmit torque in three directions, clockwise direction, counterclockwise direction and bi-direction, and operate in three ways too, rotating the tool with thumb and index finger and holding the handle with the other fingers in light torque work, as shown in FIG. 8, rotating and holding with both fingers and palm in middle torque work and rotating with a handle bar and holding with the other hand in heavy torque work, as shown in FIG. 9. Further, FIG. 7 shows that the directions of the handle tool can be adjusted using only the thumb. For the light torque work, the rotation of the tool with thumb and index finger can continue without releasing palm and other fingers because the transmission is happened only in one direction and the other direction is in neutral. This makes the rotation more stable and steady. For the middle torque work, the rotation with palm and fingers can be more stable and steady by the same structure too. For the heavy torque situation and a handle bar used, the user can rotate the handle back directly without releasing it to take the best position to apply force. The uni-directional (clockwise and counterclockwise) transmission is used in screwing or slightly reaming, and the bi-directional transmission is used in tapping. With the structure of the chuck and chucking blocks, the change of tools is as easy and convenient as the prior art. However, the hardness of the material of the chucking should be at least RC 50 of the Rockwell hardness, such as heat-treated medium carbon steel, in order not to be ruined quickly.

The utilization of the present invention is described as follows. At the beginning, the work requires light torque and high precision to begin it exactly. The user can hold the handle with his palm and fingers and rotate the tool with the most dexterous thumb and index finger to work very efficiently. In the middle of the work, higher torque is required. The user can use the hand to hold and rotate it. At the end, the highest torque is required and the user can use the handle bar to help him.

I claim:

1. A direction-changeable handle structure for a hand tool comprising:

(a) a body having a gear wheel attached thereto near a first end portion of the body, a second portion of the body having threads, and defining a slot and a chucking block seat;

(b) two arc plates extending from said chucking block seat having flat inner faces so as to form a rectangular shape when engaged with a pair of chucking blocks;

(c) a pair of chucking blocks connected by a spring clip which is located in said slot of said body, the chucking block being disposed in the chucking block seat;

(d) first and second rings threadedly attached to the second end of the body so as to transmit torque to the body, said first ring, having a relatively greater thickness, and said second ring being screwed on the threads of said body, said second ring having a relatively smaller thickness and being screwed on said threads after said first ring;

(e) a chuck bearing against a portion of the chucking blocks and threadedly engaging with the second end portion of the body adjacent to the second ring so as to attach a variety of tools to the handle;

(f) a coupling tube concentrically arranged about the body, the coupling tube defining an "H" shaped slot, a key way, a transverse hole and a spring attachment hole;

(g) a key member disposed in the key way and bearing against the body to prevent removal of the body from the coupling tube to keep the body in its position;

(h) a substantially "T" shaped plate disposed in each leg of the "H" shaped plate engaging with the gear wheel;

(i) switch means connected to the "T" shaped plates such that either one or both may engage the gear wheel so as to control the direction of torque which is exerted by the handle, the switch means being manually manipulable from the exterior of the coupling tube;

(j) a sleeve concentrically arranged about the coupling tube, the sleeve defining openings aligned with the transverse hole of the coupling tube, a switch opening and a spring attachment opening;

(k) spring biased attachment means located in the spring attachment hole and a engaging button for attaching the sleeve to the coupling tube; and (l) ball detent means located in the coupling tube so as to retain a handle bar inserted into the transverse hold.

2. A direction-changeable structure for a hand tool as set forth in claim 1, wherein the chucking blocks and the chucking block seat define a rectangular shape for engaging tools which have a rectangular engaging shank portion.

3. A direction-changeable structure for a hand tool as set forth in claim 1, wherein said direction-changeable structure forms a handle for gripping and manually turning thereof to transmit the torque.

* * * * *